US010449405B2

(12) United States Patent
Endelman et al.

(10) Patent No.: US 10,449,405 B2
(45) Date of Patent: Oct. 22, 2019

(54) ROTATABLE DISC EXERCISE APPARATUS

(71) Applicant: Balanced Body, Inc., Sacramento, CA (US)

(72) Inventors: Ken Endelman, Sacramento, CA (US); Christopher J. Savarino, Sacramento, CA (US); Kit W. Spelman, Sacramento, CA (US)

(73) Assignee: Balanced Body, Inc., Sacramento, CA (US)

( * ) Notice: Subject to any disclaimer, the term of this patent is extended or adjusted under 35 U.S.C. 154(b) by 180 days.

(21) Appl. No.: 15/802,167

(22) Filed: Nov. 2, 2017

(65) Prior Publication Data

US 2018/0117384 A1 May 3, 2018

Related U.S. Application Data

(60) Provisional application No. 62/417,090, filed on Nov. 3, 2016.

(51) Int. Cl.
*A63B 21/04* (2006.01)
*A63B 21/00* (2006.01)
(Continued)

(52) U.S. Cl.
CPC .... *A63B 21/0435* (2013.01); *A63B 21/00061* (2013.01); *A63B 21/00069* (2013.01);
(Continued)

(58) Field of Classification Search
CPC ..... A63B 21/0004; A63B 21/00058; A63B 21/00061; A63B 21/00065;
(Continued)

(56) References Cited

U.S. PATENT DOCUMENTS 1,533,500 A 4/1925 Hovda
3,512,774 A 5/1970 Honer
(Continued)

FOREIGN PATENT DOCUMENTS

GB 1203664 9/1970

OTHER PUBLICATIONS

Rotational Disc, Twist Board, Birch 13", Diameter, RiversEdge Products, downloaded from the Internet on Jan. 25, 2018 at https://www.amazon.com/Rotational-Twist-Board-Birch-Diameter/dp/B008U9ZQSE , 2016.

*Primary Examiner* — Gary D Urbiel Goldner
(74) *Attorney, Agent, or Firm* — Greenberg Traurig, LLP

(57) ABSTRACT

A rotatable disc exercise apparatus includes a first disc having a first outer planar surface and a first inner surface, a second disc fastened to the first disc and rotatably supported on the first disc by a first annular set of ball bearings and a second annular set of ball bearings. The second disc has a second outer planar surface and a second inner surface facing the first inner surface. A single biasing member sandwiched between the first and second discs resiliently biases the second disc to a neutral rotational position between the discs. The first annular set of bearings is captured between the inner surfaces by an annular outer wall of one of the discs and an inner annular rib of the other one of the discs. The second set of bearings is carried in an annular race between the first and second inner surfaces.

19 Claims, 8 Drawing Sheets

(51) Int. Cl.

| | |
|---|---|
| ***A63B 21/02*** | (2006.01) |
| ***A63B 21/22*** | (2006.01) |
| ***A63B 23/035*** | (2006.01) |
| ***A63B 71/00*** | (2006.01) |
| ***A63B 22/14*** | (2006.01) |

(52) U.S. Cl.
CPC ..... *A63B 21/025* (2013.01); *A63B 21/22* (2013.01); *A63B 21/4034* (2015.10); *A63B 21/4035* (2015.10); *A63B 21/4049* (2015.10); *A63B 22/14* (2013.01); *A63B 23/0355* (2013.01); *A63B 71/0054* (2013.01)

(58) Field of Classification Search
CPC ..... A63B 21/00069; A63B 21/00072; A63B 21/00076; A63B 21/00178; A63B 21/00181; A63B 21/00185; A63B 21/002; A63B 21/0023; A63B 21/02; A63B 21/021; A63B 21/022; A63B 21/023; A63B 21/025; A63B 21/04; A63B 21/0407; A63B 21/0414; A63B 21/0421; A63B 21/0428; A63B 21/0435; A63B 21/0442; A63B 21/045; A63B 21/0455; A63B 21/068; A63B 21/08; A63B 21/15; A63B 21/159; A63B 21/22; A63B 21/225; A63B 21/227; A63B 21/4027; A63B 21/4033; A63B 21/4034; A63B 21/4035; A63B 21/4041; A63B 21/4045; A63B 21/4047; A63B 21/4049; A63B 22/0046; A63B 22/14; A63B 22/18; A63B 2022/185; A63B 2023/003; A63B 23/035; A63B 23/03508; A63B 23/0355; A63B 26/00; A63B 26/003; A63B 71/0054; A63B 2071/0063; A63B 2071/0072; A63B 2071/0081; A63B 2071/009
See application file for complete search history.

(56) References Cited

U.S. PATENT DOCUMENTS

| | | | | |
|---|---|---|---|---|
| 3,593,994 | A * | 7/1971 | Anbar | A63B 22/14 482/147 |
| 4,576,372 | A | 3/1986 | Rinaldi | |
| 4,659,050 | A | 4/1987 | Tabayashi | |
| 4,684,124 | A * | 8/1987 | Escher | A63B 21/0004 482/110 |
| 4,787,630 | A * | 11/1988 | Watson | A63B 22/14 482/146 |
| 4,953,858 | A | 9/1990 | Zelli | |
| 5,062,629 | A * | 11/1991 | Vaughan | A63B 22/18 482/147 |
| 5,147,265 | A * | 9/1992 | Pauls | A63B 21/015 482/115 |
| 5,149,043 | A | 9/1992 | Grundmann | |
| 5,511,740 | A * | 4/1996 | Loubert | A63B 21/015 242/381 |
| 5,683,337 | A * | 11/1997 | Zetocha | A63B 22/14 482/146 |
| 5,685,514 | A | 11/1997 | Carnahan et al. | |
| 8,641,144 | B2 * | 2/2014 | Davis, Jr. | A47C 7/72 248/415 |
| 8,986,180 | B1 | 3/2015 | VanBuren et al. | |
| 9,295,873 | B1 | 3/2016 | LaCaze | |
| 9,968,820 | B2 * | 5/2018 | Stockhausen | A63B 21/22 |
| 2005/0148450 | A1 | 7/2005 | Huang | |
| 2006/0046901 | A1 * | 3/2006 | Pan | A63B 21/00 482/51 |
| 2012/0225741 | A1 * | 9/2012 | Antolick | A43B 3/0021 473/452 |
| 2014/0155236 | A1 | 6/2014 | Curry | |

* cited by examiner

ROTATABLE DISC EXERCISE APPARATUS

CROSS-REFERENCE TO RELATED APPLICATION

This application claims the benefit of priority of U.S. Provisional Patent Application Ser. No. 62/417,090, filed Nov. 3, 2016, entitled Rotatable Disc Exercise Apparatus, the content of which is incorporated herein by reference in its entirety.

BACKGROUND OF THE DISCLOSURE

The present disclosure is directed to exercise equipment and more particularly to a set of stacked rotatable discs. Conventional stacked rotatable discs include a first disc that rests on a flat support surface such as a floor. A second disc is rotatably stacked and fastened onto the first disc so as to remain aligned with the first disc as the second disc is rotated via bearings about a central axis perpendicular to the support surface by a portion of a user's body supported on the second disc. Typically the stacked rotatable discs are used in pairs. For example, a user can stand or kneel on a pair of the stacked rotatable discs and twist his or her body during an exercise, causing the second discs to rotate relative to the first discs. If the stacked discs are large enough in diameter, a user can stand or kneel on the second disc of a stacked disc set while exercising. As the user twists her body the second disc rotates relative to the support surface. These conventional rotatable discs are free to rotate relatively to each other. Their use in physical exercise regimens is limited to the agility of the user and the particular movements required.

The bearings separating the first and second disc are typically sandwiched between sheet metal plates that are interlocked together and each fastened to one of the first or second discs. Alternatively each of the bearings may be carried in an opening in an annular plastic frame that is fastened to the first and second disc via a central axial bolt that holds the frame and first and second disc together. One problem with this configuration is that dynamic side loads on the second disc relative to the first disc can be large enough such that one or more of the bearings may be dislodged from its frame, rendering the stacked set either jammed together or limited in movement between the discs. Another limitation with conventional stacked rotatable discs is that there is no rotational resistance provided between the discs such that they cannot be utilized for strengthening exercises beyond generating a momentary torque that a user can apply during body rotation.

SUMMARY OF THE DISCLOSURE

Embodiments in accordance with the present disclosure overcome problems and limitations of conventional stacked rotatable discs described above. One embodiment of a rotational disc exercise apparatus in accordance with the present disclosure includes a first disc having a first outer planar surface and a first inner surface, a second disc fastened to the first disc and rotatably supported on the first disc by a first annular set of ball bearings and a second annular set of ball bearings. The second disc has a second outer planar surface and a second inner surface facing the first inner surface. The first and second outer planar surfaces may be round, oval, rectangular or irregular in shape. A single biasing member is preferably, but optionally, sandwiched between the first and second discs. This biasing member resiliently biases the second disc to a neutral rotational position between the discs such that when the discs are placed upon a support surface, such as a floor, the two discs are stationary with the upper disc (second disc) in a rotationally neutral position above the lower disc.

Each of the first and second discs has a central hub portion symmetrical about a common central axis. The central hub portion of each disc has an outer annular wall and a concentric inner annular wall defining therebetween a first race for the first annular set of ball bearings. The single biasing member is preferably a coil spring wrapped around the central hub portions of the axially aligned and mated first and second discs. The outer annular wall of the hub portion of one of the first and second discs extends axially beyond the inner annular wall of that one of the first and second discs. This inner annular wall of the hub portion of the other, i.e., another one of the first and second discs extends axially beyond the outer annular wall of the another one of the first and second discs so that when the first and second discs are mated, the central hub portions capture the first annular set of ball bearings therebetween.

The first and second discs each having a pair of concentric annular walls spaced from the central hub portion that together form a second race for the second set of ball bearings. The single biasing member is preferably a coil spring wrapped around the central hub portions of the first and second discs, and has elongated opposite ends that extend outward from the central hub portion of the discs. One of the first and second discs has at least one post spaced from the central hub portion, projecting from the inner surface of the one of the first and second discs engaging one of the ends of the coil spring. Preferably the same one of the first and second discs has a second post spaced from the central hub portion projecting from the inner surface of the one of the first and second disc engaging the other end of the coil spring.

An exemplary embodiment of a rotatable disc exercise apparatus in accordance with this disclosure may be viewed as including a first disc having a first outer planar surface and a first inner surface and a second disc fastened to the first disc and rotatably supported on the first disc by a first annular set of ball bearings and a second annular set of ball bearings. This second disc has a second outer planar surface and a second inner surface facing the first inner surface. A single biasing member is preferably sandwiched between the first and second discs resiliently biasing the second disc to a neutral rotational position between the discs. The single biasing member is preferably a coil spring wrapped around a central hub portion of each of the first and second discs. At least one of the first and second discs has at least one post projecting from the inner surface of the one of the first and second discs engaging an end of the coil spring wrapped around the central hub portions. The coil spring has another end. The one of the first and second discs has another post projecting from the inner surface of the one of the first and second discs engaging the another end of the spring.

The central hub portion of each disc has an outer annular wall and a concentric inner annular wall defining therebetween a first race for the first annular set of ball bearings. The first and second discs each also have a pair of concentric annular walls spaced from the central hub portion defining therebetween a second race for the second set of ball bearings. The first and second discs each has at least one radial projection extending beyond a peripheral edge of the disc for indicating a rotational position of the first disc relative to the second disc. The at least one radial projection on each disc is axially aligned with the radial projection on the other of the first and second discs when the discs are in the neutral rotational position.

A rotatable disc exercise apparatus in accordance with the disclosure may also be viewed as including a first disc having a first outer planar surface and a first inner surface, a second disc axially fastened to the first disc and rotatably supported on the first disc by a first annular set of ball bearings and a second annular set of ball bearings concentrically spaced outward from the first annular set of ball bearings. The second disc has a second outer planar surface and a second inner surface facing the first inner surface. Each of the first and second discs has a central hub portion symmetrical about a common central axis. The central hub portion of each disc has an outer annular wall and a concentric inner annular wall defining therebetween a first race for the first annular set of ball bearings. Preferably a single biasing member is sandwiched between the first and second discs resiliently biasing the second disc to a neutral rotational position between the discs. This single biasing member is a coil spring wrapped around a central hub portion of each of the first and second discs. The outer annular wall of the hub portion of one of the first and second discs extends axially beyond the inner annular wall of that one of the first and second discs. The inner annular wall of the hub portion of the other one of the first and second discs extends axially beyond the outer annular wall of the other one of the first and second discs so that together the first annular set of ball bearings is captured between the inner and outer annular walls.

The apparatus also includes one of the first and second discs having at least one post projecting from the inner surface of the one of the first and second discs engaging an end of the coil spring wrapped around the central hub portions. The coil spring has another end and the one of the first and second discs has another post projecting from the inner surface of the one of the first and second discs engaging the another end of the spring to maintain the discs in alignment at the neutral position when no rotational force is applied to the set of discs.

Further features, advantages and characteristics of the embodiments of this disclosure will be apparent from reading the following detailed description when taken in conjunction with the drawing figures.

DETAILED DESCRIPTION

Figure 1:
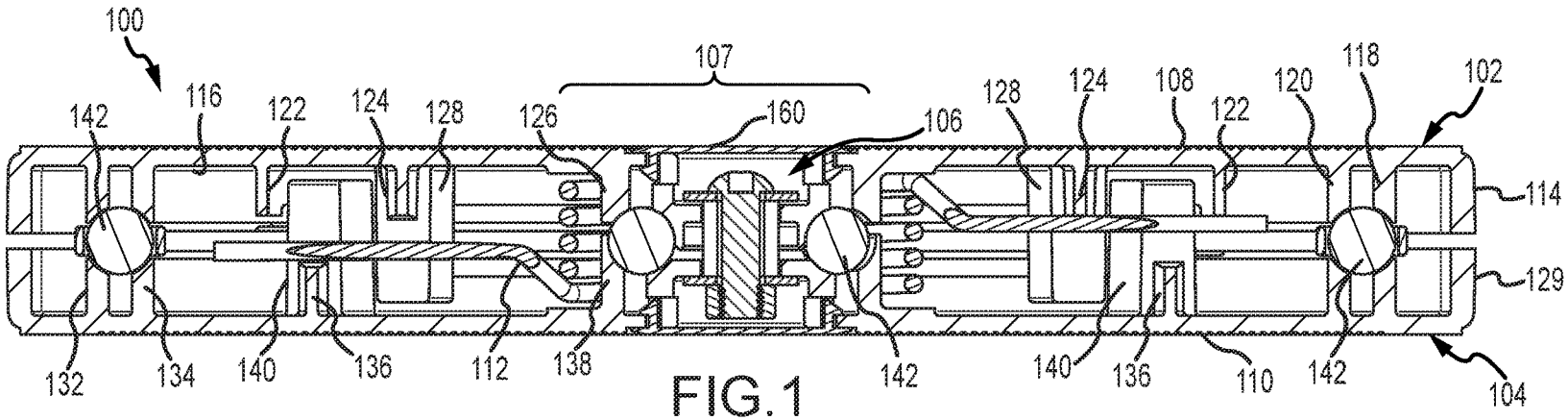
FIG. 1 is a cross sectional view of a first embodiment of a disc exercise apparatus having a lightweight coil spring in accordance with the present disclosure.

Turning now to the drawing, a cross sectional view through an exemplary stacked disc apparatus 100 is shown in FIG. 1. The apparatus 100 includes a first or upper disc 102 and a second, or lower disc 104 that are stacked atop one another and held together by an inner bearing axle bolt and nut assembly 106 in a central hub portion 107 that will described more fully with reference to FIG. 8 below, for rotation about vertical axis A. The first and second discs 102 and 104 each have an outer planar surface 108 and 110 respectively. The outer surfaces 108 and 110 may be grooved, serrated or roughened to prevent slippage of a user's foot or hand when being used, or to prevent slippage of the lower disc when the apparatus 100 is placed on a floor or other flat surface.

Figure 2:
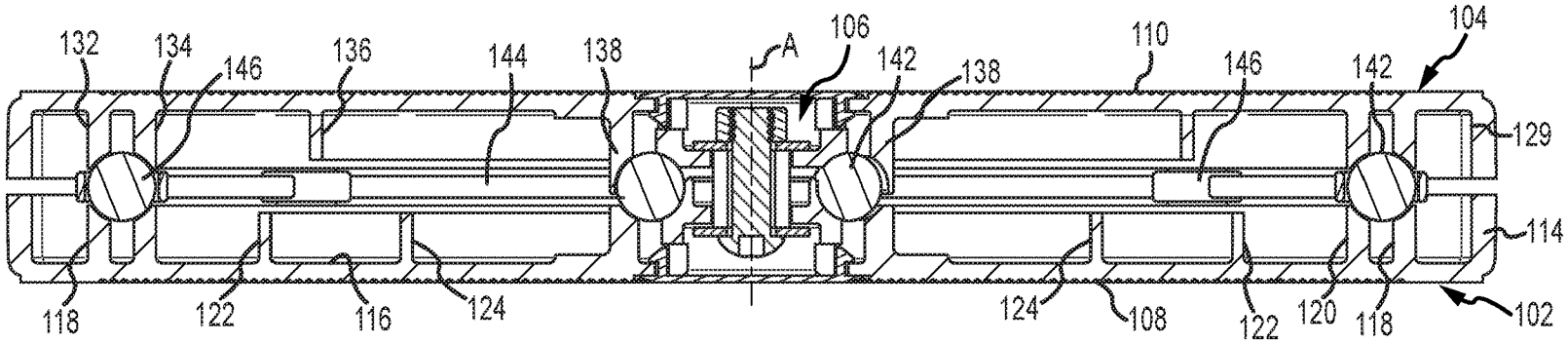
FIG. 2 is an inverted cross sectional view through the first embodiment in accordance with the present disclosure shown in FIG. 1 without having a lightweight coil spring installed.
Figure 3:
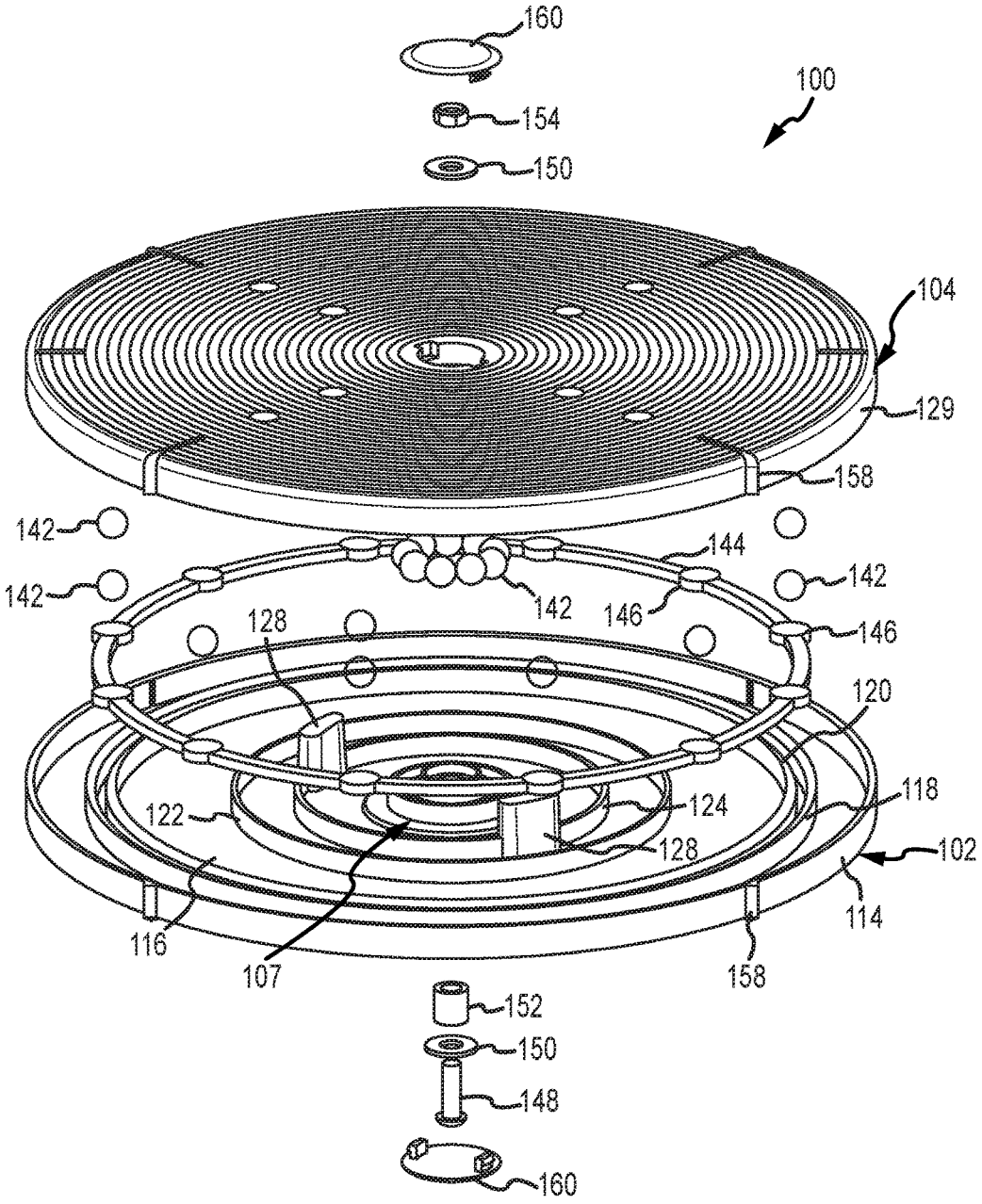
FIG. 3 is an exploded view of the disc exercise apparatus shown in FIGS. 1 and 2 without a spring installed in place.
Figure 4:
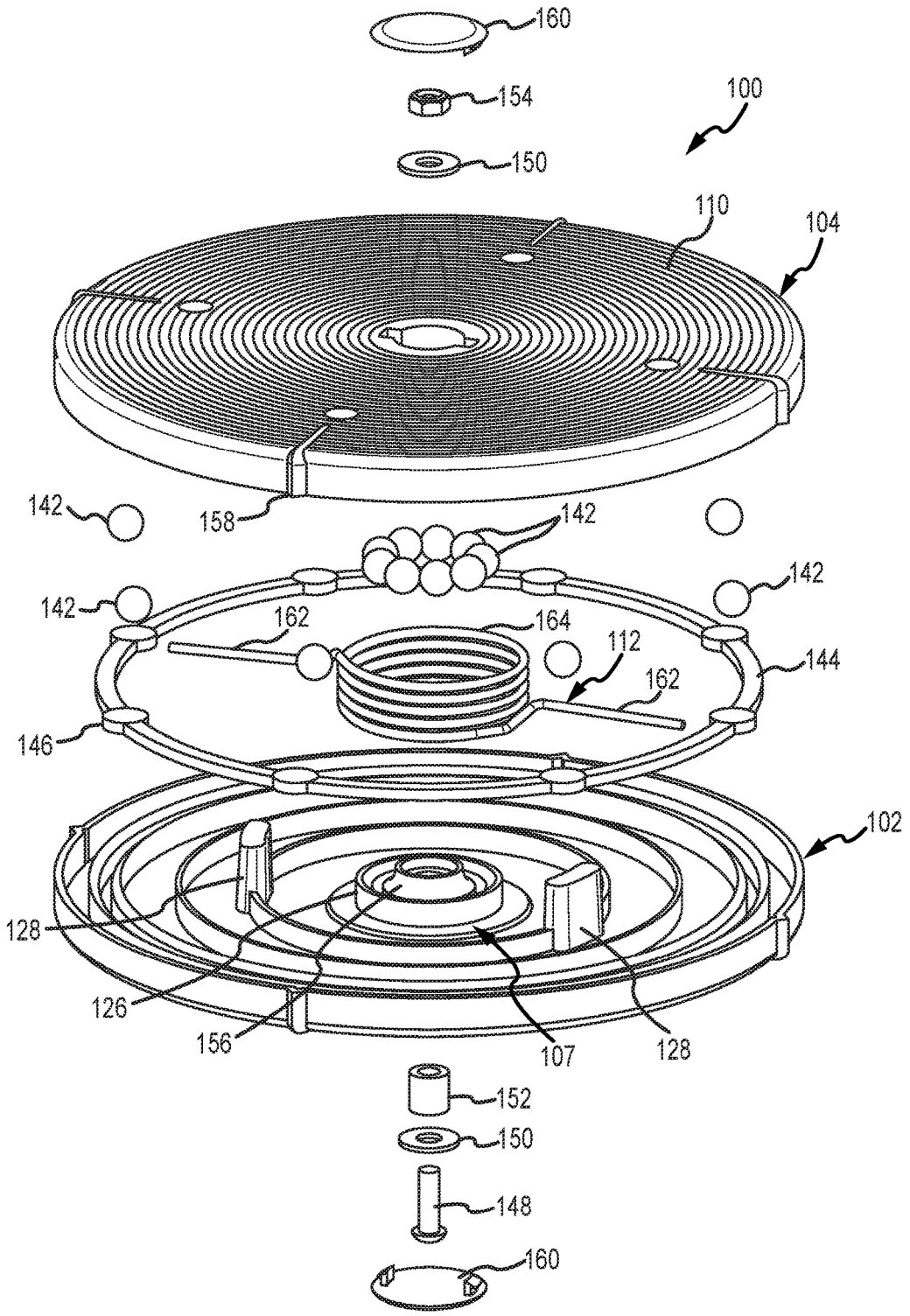
FIG. 4 is an exploded perspective view of the embodiment in FIG. 1 with a lightweight coil spring in place in accordance with the present disclosure.
Figure 5:
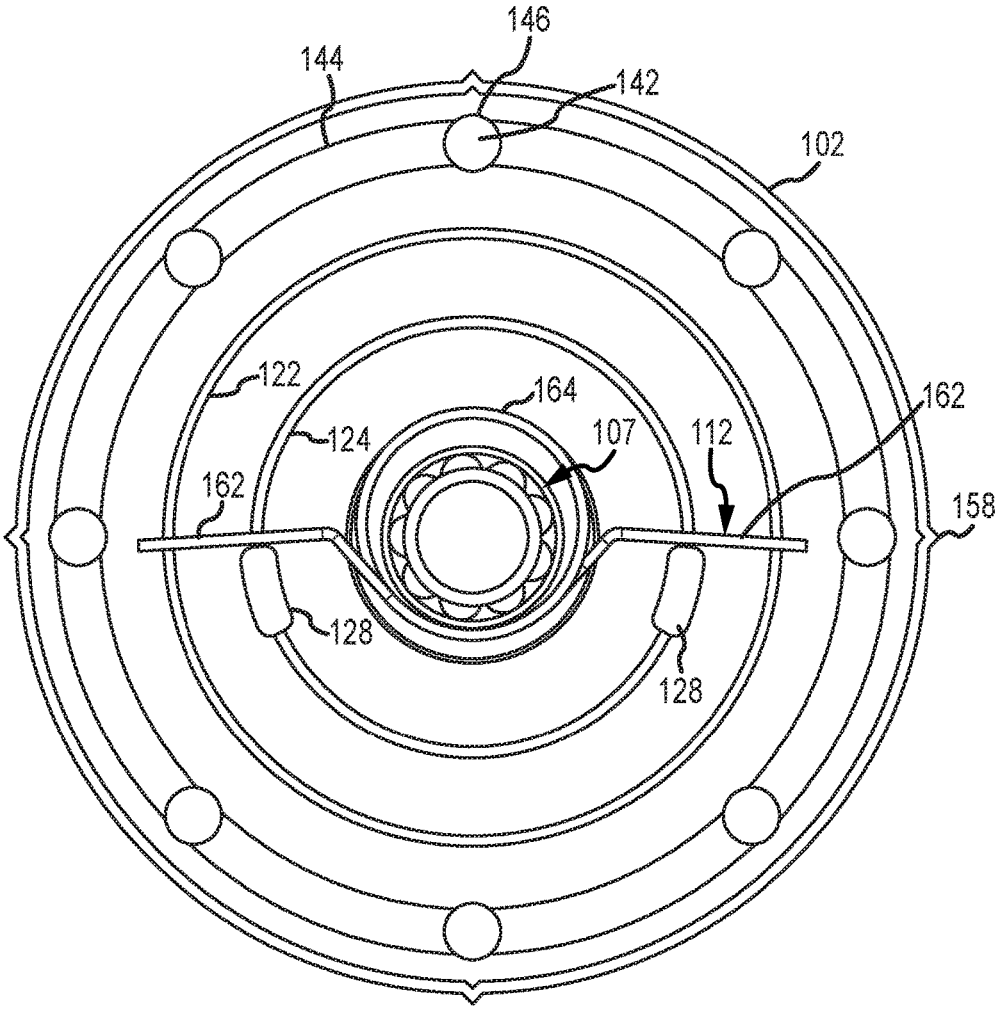
FIG. 5 is a plan view of the embodiment shown in FIG. 4 with the top disc removed.

The apparatus 100 is further shown in exploded views in FIG. 3 and FIG. 4, without and with an installed lightweight coil spring bias member 112 respectively in accordance with the present disclosure. The cross sectional view of FIG. 2 shows the apparatus 100 inverted, with a bias member in accordance with the present disclosure removed to clearly show the inner features of the discs 102 and 104. The sectional views of FIGS. 2 and 3 closely correspond and will be used to describe the components of and between the discs 102 and 104.

The first disc 102, i.e., the bottom disc in FIGS. 2 and 3, has a flat outer surface 108, an annular outer rim 114, and an inner surface 116. Projecting concentrically from the inner surface 116 of the first disc 102, are a pair of concentric annular outer bearing race support ribs 118 and 120, an outer annular rib 122, an inner annular rib 124, and an inner bearing race rib forming the short outer race 126 of the central hub portion 107 carrying the inner bearing axle bolt and nut assembly 106.

A pair of posts 128 project from the inner annular rib 124 on opposite sides of the inner bearing axle bolt and nut assembly 106 as shown in FIGS. 1 and 3. The purpose of these posts 128 is to engage portions of opposing ends of the lightweight bias member 112 or heavy bias member 170 described more fully below. The annular outer rib 122 provides structural support to the first disc 102 as does the annular inner rib 124 between the hub 107 and assembly 106 and the outer bearing race ribs 118 and 120.

The second disc 104 similarly has a flat outer surface 110, a circular outer rim 129 and an inner surface 130. Projecting from the inner surface 130 concentrically are a pair of annular outer bearing race ring support ribs 132 and 134, a concentric annular support rib 136, and an inner bearing race rib forming the tall outer race 138 of the hub portion 107 confining the inner bearings 142 and the inner bearing axle bolt and nut assembly 106. Projecting from the concentric annular support rib 136 are a pair of posts 140 on opposite sides of the hub portion 107 and inner bearing axle bolt and nut assembly 106 as shown in FIG. 1.

Sandwiched between the first and second discs 102 and 104 is an inner set of ball bearings 142 carried in the hub portion 107 and confined by the inner bearing/axle bolt and nut assembly 106, and an outer set of ball bearings 142 supported in a spaced relation in a separate carrier ring 144. Carrier ring 144 is a plastic ring with recesses 146 to maintain the outer set of bearings 142 in spaced radial relation while they roll between the race ribs 118, 120, 132, and 134 when the apparatus 100 is assembled.

Referring now to FIGS. 2, 3, 4 and 8 the hub portion 107 and inner bearing/axle support assembly 106 will be described. The assembly 106 includes the central set of bearings 142, an axle bolt 148, two washers 150 on either end of a spacer sleeve 152 and a nut 154 that together capture the set of bearings 142 within hub portion 107, i.e., between an inner annular upper race member 155, inner lower race member 156, and outer race members 126 and 138 within the central hub portion 107 of the apparatus 100. Together, these four race rib members 155, 156, 126 and 138 confine the bearings 142 and support the first and second discs 102 and 104.

Figure 8:
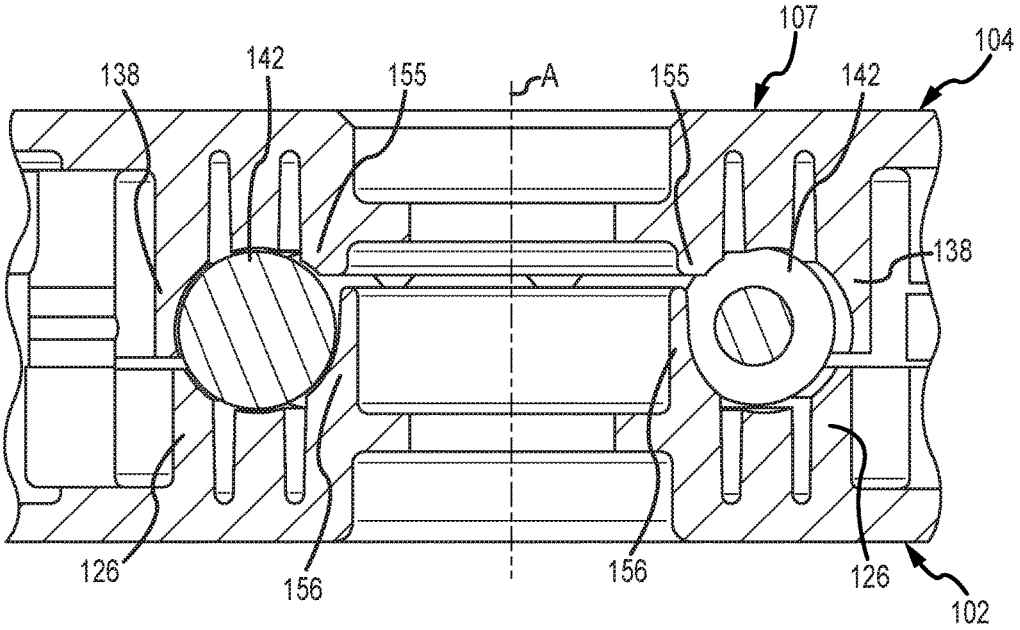
FIG. 8 is an enlarged partial sectional view of the inner bearing arrangement of the apparatus shown in FIGS. 1 through 7 in accordance with the present disclosure.

An enlarged cross section of the central hub portion 107, with the axle bolt 148, spacer 152, washers 150, and nut 154 removed, is shown in cross section in FIG. 8. The hub portion 107 of the discs 102 and 104 (upper and lower discs) combine with steel ball bearings 142 in the middle. One unique feature of the present disclosure concerns how the center set of bearings 142 are supported. The bottom half of the disc set, or disc 102, has a longer leg or projecting rib of the inner race 156 for the inner bearing set 142 and a smaller hump on the outside, i.e., race rib 126. The top half, of the disc set, i.e. disc 104, has a longer leg i.e. projecting outer race rib 138. When the axle bolt 148 and spacer 152 and washers 150 are installed, the discs 102 and 104 are drawn to and fastened securely together but are free to rotate relative to each other. So when there is side load applied to the top disc 104 the bearings 142 are secure in their track position, held in place, and will not roll out. The combination of the higher ledge or outer rib 138 and the higher inner rib 156 will stop the balls 142 from coming out, thus giving the user more control and stability if any angle or side load is applied to the assembled set of first and second, or upper and lower discs 102 and 104.

Figure 9:
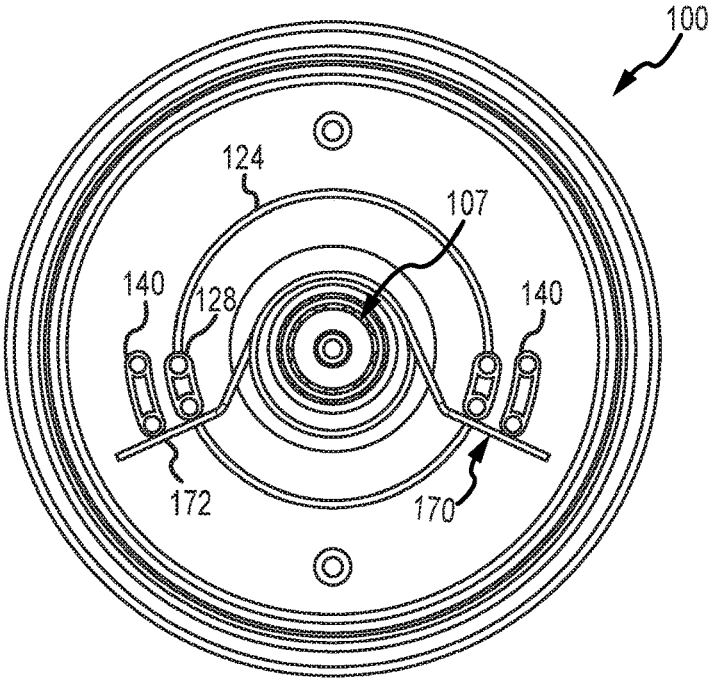
FIG. 9 is a plan view of the embodiment shown in FIGS. 6 and 7 with the top disc transparent, showing the arrangement of spring posts against the heavy spring.
Figure 10:
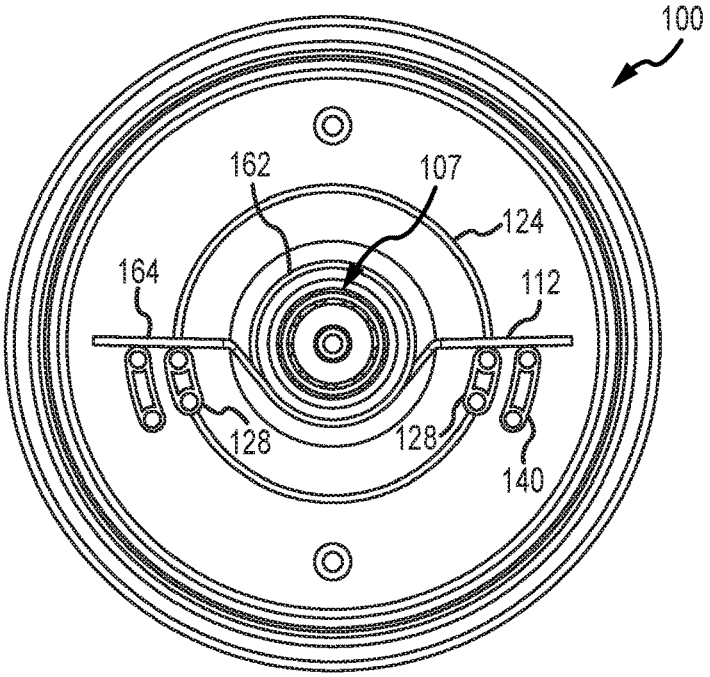
FIG. 10 is a plan view of the embodiment shown in FIGS. 1, 4 and 5 with the top disc showing the arrangement of spring posts against the lightweight spring.

The second feature involves incorporating a coil spring 112 inside and between the rotator discs which will give the disc increasing resistance when the upper disc is rotated with respect to the lower disc away from an aligned neutral position dictated by the placement of the posts 128 and 140. We can install a 'light' spring 112 or a 'heavy' spring 170. The image of the apparatus 100 shown in FIG. 9 is shown with the first (upper) disc transparent, revealing a heavy spring 170 around the hub portion 107 and assembly 106 of the disc apparatus 100. FIG. 10 is the same set of stacked discs 102 and 104 but with a light spring 112 installed.

This gives a different resistance depending on which spring is installed. For hand and arm work the light spring shown in FIG. 10 is preferred. For leg work, a heavy spring as is shown in FIG. 9 is preferably used. Heavy spring 170 provides 130 degrees travel, and the light spring 112 has 180 degrees of travel. Once turned and released, they will return back to 'home' or neutral position. These discs can spin in either direction the same amount of rotation. Also if the springs 112 or 170 are removed, the discs 102 and 104 have infinite amount of rotation in either direction.

Each of the first and second discs 102 and 104 preferably include radial raised markers 158 at 90 degree locations therearound so that a user can gauge the extent of rotation of the upper disc relative to the lower disc during use. Finally, end caps 160 may be installed over the assembly 106 top and bottom.

The coil spring 112 is preferably a spring having a central coiled portion 162 and a pair of elongated straight leg ends 164 that extend in generally opposite directions. When installed around the hub portion 107 in the assembled apparatus 100, these ends 164 engage the posts 128 and 140 to cause the discs 102 and 104 to bias to a neutral position with respect to each other.

Figure 6:
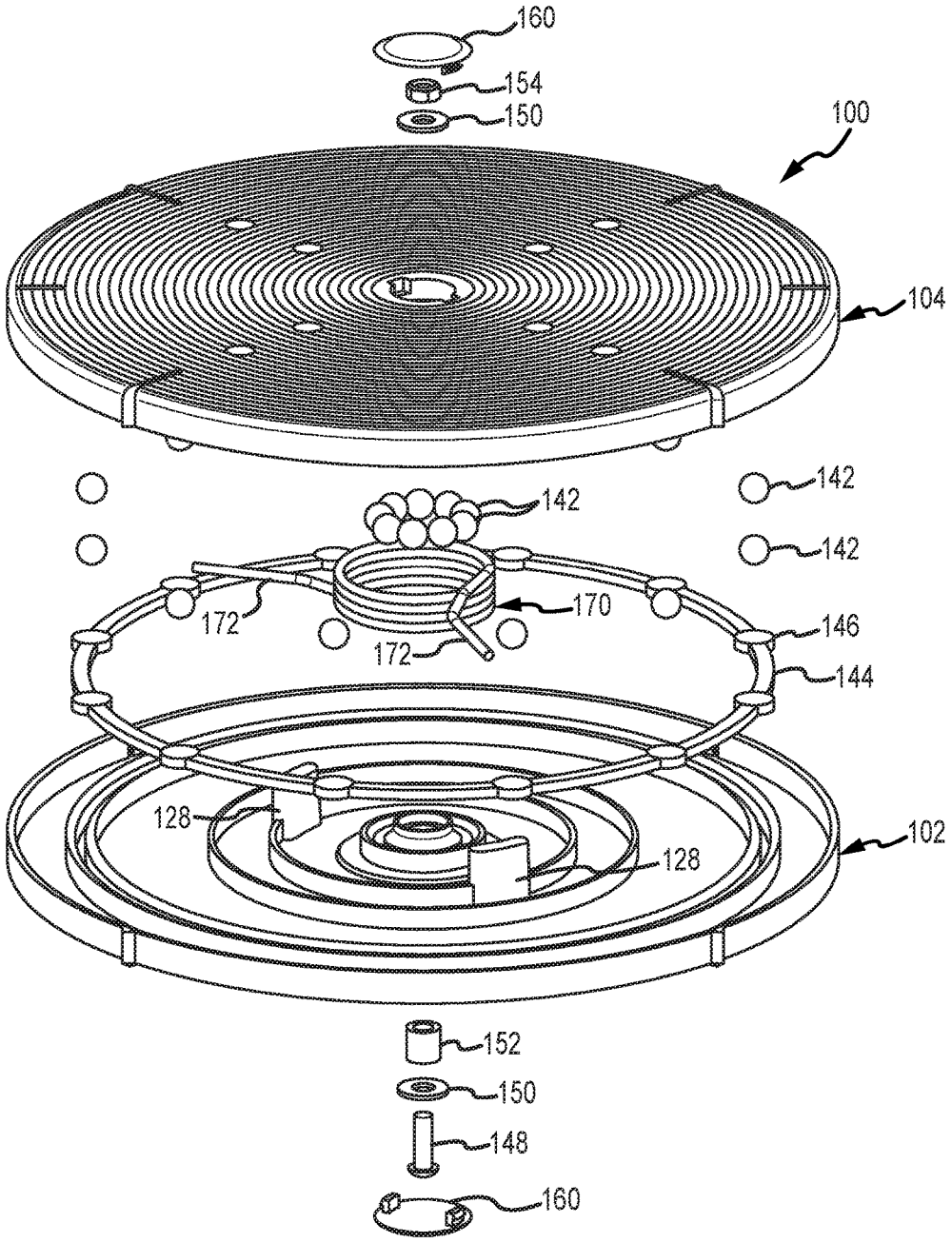
FIG. 6 is an exploded perspective view of an embodiment in accordance with the present disclosure with a heavy spring in place of the lightweight spring shown in FIGS. 4 and 5.
Figure 7:
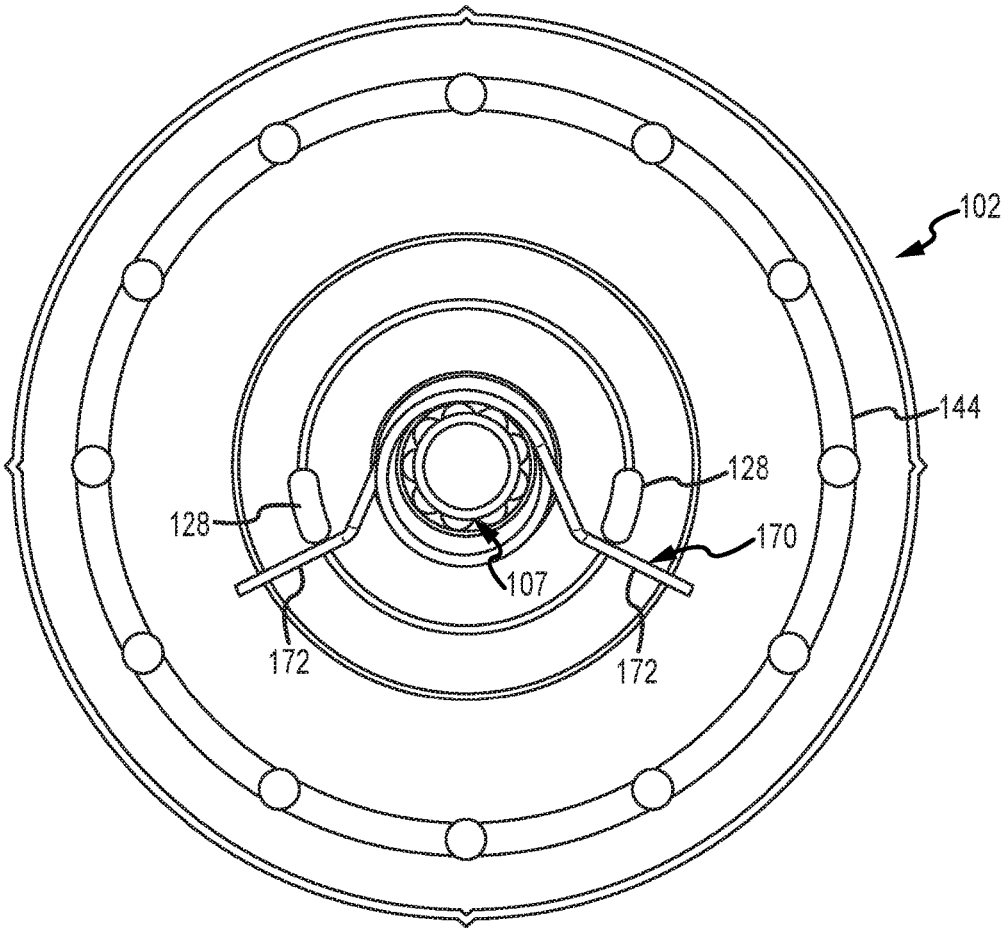
FIG. 7 is a plan view of the heavy spring embodiment in accordance with the present disclosure shown in FIG. 6, again with the top disc removed.

Referring now to FIGS. 6, 7 and 9, therein is shown a heavy spring 170 installed between discs 102 and 104. All of the other component parts remain the same. However, note that the end portions 172 of the spring 170 are oriented on the other sides of the posts 128 as the spring rate is greater.

Many variations will become apparent to a reader of this disclosure. For example, the first and second discs illustrated have circular outer planar surface shapes. They need not be circular. The disks may alternatively have oval, rectangular, or irregular outer surface planar shapes. For example, they may each have an outer surface planar shape in the outline of a user's foot or hand. All such changes, alternatives and equivalents in accordance with the features and benefits described herein, are within the scope of the present disclosure. Any or all of such changes and alternatives may be introduced without departing from the spirit and broad scope of this disclosure and the appended claims.

The invention claimed is:

1. A rotatable disc exercise apparatus comprising:

a first disc having a first outer planar surface and a first inner surface;

a second disc fastened to the first disc and rotatably supported on the first disc by a first annular set of ball bearings and a second annular set of ball bearings, the second disc having a second outer planar surface and a second inner surface facing the first inner surface; and a single biasing member sandwiched between the first and second discs resiliently biasing the second disc to a neutral rotational position between the first and second discs, wherein each of the first and second discs has at least one radial projection extending beyond a peripheral edge of the respective disc for indicating a rotational position of the first disc relative to the second disc and wherein the at least one radial projection on one of the first and second discs is axially aligned with the at least one radial projection on the other of the first and second discs when the first and second discs are in the neutral rotational position.

2. The apparatus according to claim 1 wherein each of the first and second discs has a central hub portion symmetrical about a common central axis.

3. The apparatus according to claim 2 wherein the central hub portion of each of the first and second discs has an outer annular wall and a concentric inner annular wall defining therebetween a first race for the first annular set of ball bearings.

4. The apparatus according to claim 2 wherein the single biasing member is a coil spring wrapped around the central hub portions of the first and second discs.

5. The apparatus according to claim 2 further comprising the first and second discs each having a pair of concentric annular walls spaced from the central hub portion defining therebetween a second race for the second set of ball bearings.

6. The apparatus according to claim 5 wherein the central hub portion of each disc has an outer annular wall and a concentric inner annular wall defining therebetween a first race for the first annular set of ball bearings.

7. The apparatus according to claim 6 wherein the single biasing member is a coil spring wrapped around at least one of the central hub portions of the first and second discs.

8. The apparatus according to claim 7 wherein one of the first and second discs has at least one post spaced from the respective central hub portion and projecting from the respective inner surface of the one of the first and second disc, wherein the at least one post engages an end of the coil spring.

9. The apparatus according to claim 8 further comprising the one of the first and second discs having a second post spaced from the central hub portion and projecting from the respective inner surface of the one of the first and second disc, wherein the second post engages another end of the coil spring.

10. A rotatable disc exercise apparatus comprising:

a first disc having a first outer planar surface and a first inner surface;

a second disc fastened to the first disc and rotatably supported on the first disc by a first annular set of ball bearings and a second annular set of ball bearings, the second disc having a second outer planar surface and a second inner surface facing the first inner surface; and a single biasing member sandwiched between the first and second discs resiliently biasing the second disc to a neutral rotational position between the first and second discs, wherein each of the first and second discs has a central hub portion symmetrical about a common central axis, wherein the central hub portion of each of the first and second discs has an outer annular wall and a concentric inner annular wall defining therebetween a first race for the first annular set of ball bearings, and wherein the outer annular wall of the central hub portion of one of the first and second discs extends axially beyond the concentric inner annular wall of that one of the first and second discs and the concentric inner annular wall of the central hub portion the other of the first and second discs extends axially beyond the outer annular wall of that other of the first and second discs, whereby the concentric inner annular walls and the outer annular walls cooperate to retain the annular first set of ball bearings between the first and second discs.

11. A rotatable disc exercise apparatus comprising:

a first disc having a first outer planar surface and a first inner surface;

a second disc fastened to the first disc and rotatably supported on the first disc by a first annular set of ball bearings and a second annular set of ball bearings, the second disc having a second outer planar surface and a second inner surface facing the first inner surface; and a single biasing member sandwiched between the first and second discs resiliently biasing the second disc to a neutral rotational position between the first and second discs, wherein the single biasing member is a coil spring wrapped around a central hub portion of each of the first and second discs, wherein each of the first and second discs has at least one radial projection extending beyond a peripheral edge of the respective disc for indicating a rotational position of the first disc relative to the second disc and wherein the at least one radial projection on one of the first and second discs is axially aligned with the at least one radial projection on the other of the first and second discs when the first and second discs are in the neutral rotational position.

12. The apparatus according to claim 11 further comprising one of the first and second discs having at least one post projecting from the respective inner surface of the first and second discs engaging an end of the coil spring wrapped around the central hub portions.

13. The apparatus according to claim 12 wherein the coil spring has another end and the one of the first and second discs has another post projecting from the respective inner surface of the first and second discs engaging the another end of the spring.

14. The apparatus according to claim 12 wherein the central hub portion of each of the first and second discs has an outer annular wall and a concentric inner annular wall defining therebetween a first race for the first annular set of ball bearings.

15. The apparatus according to claim 14 further comprising the first and second discs each having a pair of concentric annular walls spaced from the central hub portion defining therebetween a second race for the second set of ball bearings.

16. A rotatable disc exercise apparatus comprising:

a first disc having a first outer planar surface and a first inner surface; and a second disc fastened to the first disc and rotatably supported on the first disc by a first annular set of ball bearings and a second annular set of ball bearings, the second disc having a second outer planar surface and a second inner surface facing the first inner surface, wherein each of the first and second discs has a central hub portion symmetrical about a common central axis, the central hub portion of each of the first and second discs having an outer annular wall and a concentric inner annular wall defining therebetween a first race for the first annular set of ball bearings; and wherein the concentric inner annular wall and the outer annular wall of the central hub portion of one of the first and second discs have different axial heights, the concentric inner annular wall and the outer annular wall of the central hub portion of the other of the first and second discs have different axial heights, the concentric inner annular walls have different axial heights, and the outer annular walls have different axial heights, whereby the respective axial heights cooperate to retain the annular first set of ball bearings between the first and second discs and in place against side loads applied to the first and second discs.

17. The apparatus according to claim 16 wherein the outer annular wall of the hub portion of the one of the first and second discs extends axially beyond the concentric inner annular wall of that one of the first and second discs and the concentric inner annular wall of the hub portion of the other of the first and second discs extends axially beyond the outer annular wall of the other of the first and second discs.

18. The apparatus according to claim 16 further comprising one of the first and second discs having at least one post projecting from the respective inner surface of the one of the first and second discs, wherein the at least one post engages an end of a coil spring, and wherein the coil spring is wrapped around the respective central hub portions.

19. The apparatus according to claim 18 wherein the coil spring has another end and the one of the first and second discs has another post projecting from the respective inner surface of the one of the first and second discs, wherein the another post engages the another end of the coil spring.

* * * * *